US012324535B2

(12) United States Patent
Noblett

(10) Patent No.: US 12,324,535 B2
(45) Date of Patent: Jun. 10, 2025

(54) TREE STAND

(71) Applicant: Joseph Noblett, Preston (GB)

(72) Inventor: Joseph Noblett, Preston (GB)

(73) Assignee: Joseph Noblett, Preston (GB)

( * ) Notice: Subject to any disclaimer, the term of this patent is extended or adjusted under 35 U.S.C. 154(b) by 116 days.

(21) Appl. No.: 17/622,760

(22) PCT Filed: Jun. 23, 2020

(86) PCT No.: PCT/GB2020/051512

§ 371 (c)(1),
(2) Date: Dec. 24, 2021

(87) PCT Pub. No.: WO2020/260863

PCT Pub. Date: Dec. 30, 2020

(65) Prior Publication Data

US 2022/0248889 A1 Aug. 11, 2022

(30) Foreign Application Priority Data

Jun. 27, 2019 (GB) ..... 1909251

(51) Int. Cl.
*A47G 33/12* (2006.01)

(52) U.S. Cl.
CPC ..... *A47G 33/12* (2013.01); *A47G 2033/1286* (2013.01)

(58) Field of Classification Search
CPC ..... A47G 33/12; A47G 2033/1286
See application file for complete search history.

(56) References Cited

U.S. PATENT DOCUMENTS

| | | | | | |
|---|---|---|---|---|---|
| 340,692 | A | | 4/1886 | Bailey | |
| 1,421,340 | A | | 6/1922 | Zelazo | |
| 1,784,090 | A | | 12/1930 | Dahl | |
| 2,071,887 | A | | 2/1937 | Malin | |
| 2,655,331 | A | * | 10/1953 | Merritt | A47G 33/12 248/528 |
| 2,746,700 | A | * | 5/1956 | Barbera | A47G 33/1226 248/516 |
| 2,893,668 | A | * | 7/1959 | Applegate | A47G 33/1226 248/516 |

(Continued)

FOREIGN PATENT DOCUMENTS

DE 202014002205 U1 6/2015

OTHER PUBLICATIONS

International Search Report and Written Opinion of the International Search Authority in International Patent Appl. No. PCT/GB2020/051512, dated Aug. 28, 2020, 15 pages.

(Continued)

*Primary Examiner* — Monica L Perry
*Assistant Examiner* — Aaron M Rodziwicz
(74) *Attorney, Agent, or Firm* — Bochner PLLC; Andrew Bochner

(57) ABSTRACT

A tree stand includes a projection comprising a plurality of ribs for insertion into the cut end of a tree trunk to thereby engage and support the tree, wherein the projection is upwardly-orientated, and the ribs are upwardly-orientated. A method of securing a cut tree within a tree stand includes providing the tree stand and using mechanical force to insert the projection of the tree stand into the cut end of the tree.

13 Claims, 8 Drawing Sheets

(56) References Cited

U.S. PATENT DOCUMENTS 2,987,282 A 6/1961 Huff
2,997,264 A * 8/1961 Zelenitz ..... A47G 33/1226 248/516
3,033,505 A * 5/1962 Brown ..... A47G 33/12 D11/130.1
3,142,464 A * 7/1964 Zelenitz ..... A47G 33/1226 248/188.7
3,231,226 A * 1/1966 Rossler ..... A47G 33/12 248/524
3,272,462 A * 9/1966 Apple ..... A47G 33/12 248/346.03
3,862,733 A * 1/1975 Sullivan ..... A47G 33/12 248/529
4,126,963 A * 11/1978 Dunbar ..... A47G 33/12 248/146
4,408,415 A 10/1983 Davis
4,610,356 A * 9/1986 Porter ..... A47G 33/12 47/84
4,762,454 A * 8/1988 Davis ..... F16B 15/00 411/452
4,973,211 A * 11/1990 Potucek ..... F16B 15/00 411/452
5,350,149 A * 9/1994 Evans, Jr. ..... A47G 33/12 47/40.5
5,375,807 A * 12/1994 Claas ..... A47G 33/12 248/514
5,507,117 A * 4/1996 Kalman ..... A47G 33/1213 248/516
D381,598 S * 7/1997 Roberts ..... D11/130.1
5,791,626 A * 8/1998 Reese ..... A47G 33/12 248/524
6,070,848 A * 6/2000 Ogren ..... A47G 33/12 248/188.4
6,745,991 B1 * 6/2004 Rush ..... A47G 33/12 47/40.5
7,131,621 B2 * 11/2006 Welzen ..... A47G 33/1226 248/514
8,881,451 B2 * 11/2014 Noblett ..... A01G 7/06 47/40.5

OTHER PUBLICATIONS

Examination Report of the European Patent Office in related European Patent Appl. No. 20734620.6, dated Mar. 21, 2024, 4 pages.

* cited by examiner

TREE STAND

FIELD OF THE INVENTION

The invention relates to tree stands, and in particular, but not exclusively to Christmas tree stands. The invention also relates to kits of parts for assembly into a tree stand, and associated methods of supporting a tree.

BACKGROUND TO THE INVENTION

It is known to place a cut tree in a stand, to support the tree for presentation and to enable the tree to be decorated with any desired items. Particularly at Christmas time, cut trees, usually fir or spruce trees, are placed in Christmas tree stands for presentation in a domestic environment, to be decorated with appropriate Christmas decorations.

There are various types of stands available for securing a Christmas tree. One commonly used type of stand is a section of a relatively large tree trunk which has a recess cut or bored partway therein. The cut trunk end of a Christmas tree is simply inserted into the recess in the stand. The weight of the section of effects stabilization of the Christmas tree held in the recess and reduces the chance of the tree toppling. The circumference of the trunk of the Christmas tree is usually chosen, or worked by machining, to be substantially identical or slightly larger than the circumference of the recess in the stand, to enable a snug fit of the tree in the stand. A problem with the above-mentioned type of stand is that, due to the snug fit of the Christmas tree in the recess, there is no provision for a water reservoir which will enable the cut end of the tree to draw water and increase the working decorative lifetime of the tree.

A second known type of stand comprises a generally cylindrical tube having a number of apertures into which screws can be threaded. When a tree is inserted into the stand, the screws may be inserted such that they protrude into the cylinder and engage the trunk of the tree in order to tightly restrain the tree in the stand. The stand is commonly connected to, or forms part of a weighted base member which helps to prevent the tree and stand from toppling over in use. A disadvantage with this type of stand is the need for a user to bend over or kneel in order to loosen and tighten screws once a tree has been inserted. This is particularly problematical for elderly or infirm persons. Furthermore, the screws commonly work loose over a period of time, especially if the tree is moved, for example when being decorated.

A third known type of stand comprises a single vertical spike that can be inserted into the centre of the cut tree trunk, with a three-pronged base to support the spike and help stabilise the tree. The present invention provides an alternative these types of stand, and aims to facilitate engagement of the tree with the stand, provide a stable support for the tree and improve the capacity for water uptake to thereby increase the working decorative lifetime of the tree.

SUMMARY OF THE INVENTION

In a first aspect, there is provided a tree stand comprising: a projection comprising a plurality of ribs for insertion into the cut end of a tree trunk to thereby engage and support the tree, wherein the projection is upwardly-orientated, and the ribs are upwardly-orientated.

The plurality of ribs, which are arranged to extend out from the projection, help to increase the surface area which is in contact with the inside of the cut tree trunk. The increased contact area improves the stabilisation of the tree. The projection and plurality of ribs act to secure the tree to the tree stand.

Further, the ribs are arranged to insert into the layer of the tree trunk which comprises xylem. Xylem is the component responsible for the transport of water within the tree. As such, when the projection is provided with a fluid reservoir, the ribs act to enhance water uptake through this region. This helps to extend the time-period that the tree is green and more aesthetically pleasing.

As used herein the term "plurality of ribs" means that at least two ribs are present. In an example at least, three, or at least four ribs are present. In an example, at least 10 ribs are presented, or at least 20. As will be appreciated, where additional characteristics are described for the ribs of the plurality of ribs, these additional characteristics may apply to one, two, more than two, some or all of the ribs of the projection. That is to say, the ribs in the plurality of ribs may comprise one or more subsets, with different characteristics of being present for ribs as between the subsets. For example, the plurality of ribs may comprise a first subset in which all the ribs are of a first type, and a second subset in which all the ribs are of a second type, and so on.

The ribs may be arranged on the outside of the projection. The ribs may be arranged on the outside surface of the projection. In one example the ribs are formed integrally with the projection. Alternatively, the ribs may be formed separately and then connected to the projection. As such, the ribs may be provided as an attachment for the projection.

In order to support the tree in an upright position the projection is upwardly-orientated, from the surface on which the tree stand rests. In an example the projection is vertically-orientated.

Suitably the ribs are upwardly-orientated, from the surface on which the tree stand rests. In an example the ribs are vertically-orientated.

Both the projection and ribs may be orientated in the same direction.

The projection and ribs are intended to be inserted into the cut end of a tree trunk. The cut end of the tree trunk may be a substantially flat surface, into which the projection and ribs should be inserted, for example centrally relative to the trunk of the tree. In use, the projection, ribs and tree trunk are orientated in the same direction, with the projection and ribs arranged within the tree trunk, passing upwardly into the cut end of the tree.

The projection may be produced from one or more of various suitable materials. As the projection is to be inserted into the tree the projection is made from material with suitable structural integrity. In suitable examples, the projection comprises a plastics material. In one example the projection comprises one or more of a polymeric material, plastic, composite material, polycarbonate, acrylonitile butadiene styrene (ABS), polyethylene terephthalate (PET), polyamide-imide (PAI), polybutylene terephthalate (PBT), polyvinyl chloride (PVC), polyethylene (PE) and ultra-high molecular weight polyethylene (UHMW).

The projection may comprise metal (including alloy), iron, cast iron, aluminium or stainless steel. The projection and the ribs may be produced from the same or different materials.

The ribs are arranged to extend outwards from the projection. In an example the ribs project radially outwards from the outer surface of the projection. The ribs may be arranged parallel to one another around the projection. The ribs may be arranged at substantially even intervals around the projection.

The ribs may be rectilinear, extending from the base of the projection to the tip. The depth of the ribs may vary along the length of the rib. The ribs may be of a depth which tapers along the length of the rib. For example, the depth of the rib at the base of the projection may be longer than the depth of the rib at the tip of the projection.

The ribs may have a thickness which varies along the length of the rib. The ribs may have a thickness which tapers along the length of the rib. For example, the ribs may have a thickness which is smaller at the end thereof away from the projection than at the end at the projection.

The projection is provided in a shape which is suitable to be inserted into the cut end of a tree trunk, for example the projection is generally cylindrical or an oblong. The projection may be either solid or hollow. The projection may be open at one end, preferably at the upper end. In an example embodiment the projection is provided as a hollow cylinder. The cylinder may be closed at the base end and open at the upper end. The projection may be the same width along the length of the projection, or the projection may be tapered at one end. The projection may have a wall thickness which increases toward the base of the projection.

The projection may also comprise strengthening components. Wherein the projection is hollow, the strengthening components may be arranged on the inner surface of the projection. In an example, the strengthening components may be ribs. These strengthening ribs can be formed integrally with the projection.

Alternatively, the strengthening component may be provided as a removable insert. Wherein the projection is hollow, the strengthening insert may be arranged to insert within the hollow projection. As such, the strengthening insert may contact the inner surface of the hollow projection.

The strengthening components/insert may comprise metal (including alloy), for example iron, cast iron, aluminium or stainless steel. It is also suitable to form the strengthening components/insert from plastics with strong structural integrity.

The projection and the ribs are arranged to allow the ribs to contact the inside of a cut end of a tree trunk. By suitable choice of tree, the ribs should in use contact the xylem-containing portion of the cut tree trunk. As used herein the term "xylem" has its usual meaning within the art. The xylem-containing portion of the tree is usually found between the bark and the centre of the trunk. The xylem comprises a network of cells which connect to form long tubes to transport water and soluble minerals from the base of the base of the tree to the leaves.

In one example, to allow the ribs to contact and cut into the xylem the ribs comprise a sharp or pointed region to aid penetration of the cut end of the tree trunk, in particular the xylem containing portion. By contacting the xylem the ribs provide a pathway for water to enter the tree thereby enhancing water uptake by the tree. The ribs increase the area of xylem which is penetrated, as compared that of an equivalent solid projection of similar overall external dimensions.

In one example the tree stand also comprises a fluid reservoir.

In an embodiment the projection is formed integrally with the base of the tree stand. In one example, the projection is formed within the fluid reservoir to in use allow water in the fluid reservoir to contact the cut end of the tree.

The projection may be provided as a removable insert which can then be connected to the base of the tree stand. In one example the insert is to be connected within the fluid reservoir. Suitably there is an appropriate insert receiving region within the tree stand. The insert may be connected to the tree stand by any suitable means, for example it is a push fit within the tree stand. The insert may also comprise a lip and/or other suitable interference-fit portion to engage with the tree stand, to limit its insertion into the tree stand, and/or hold the projection in place with the tree stand.

The tree stand according to the present invention may further comprise a tree-receiving portion, arranged to receive the cut end of a tree trunk.

In an embodiment the fluid reservoir and tree-receiving portion both comprise generally cylindrical members with the tree-receiving portion being connected concentrically within the fluid reservoir to the closed end of the fluid reservoir. The tree-receiving portion may comprise apertures to allow fluid transfer between the fluid reservoir and the tree-receiving portion.

In an embodiment the base of the fluid reservoir and/or the tree-receiving portion may comprise spacers. These spacers act to elevate the base of the cut end of the tree trunk and allow water contact. The spacers may extend out radially from the centre of the tree stand, and/or may comprise indents or apertures to aid water transfer.

The base of the tree-receiving portion may be concave, for example to aid water contact with the base of the tree.

The tree stand may comprise a base member connected to the fluid reservoir or formed integrally with the fluid reservoir.

The tree stand may comprise a plurality of legs, which in use, are arranged to engage a surface on which the tree stand is mounted.

The tree stand may also comprise strengthening elements. The strengthening elements may include at least three, preferably at least four strengthening ribs. The ribs are positioned at substantially even intervals about the tree retaining member. The ribs are substantially identical.

In one example the ribs extend from the tree-receiving portion toward the fluid reservoir. The ribs connect between the tree retaining member and the fluid reservoir. The ribs protrude from the base of the fluid reservoir.

The strengthening ribs, within the fluid reservoir, may comprise indents or apertures to aid fluid transfer throughout the fluid reservoir.

The tree-receiving portion may also comprise a tree-retaining components arranged to grip the end of the tree trunk. The tree-receiving portion and the tree retaining act to further stabilise the tree within the stand.

A number of tree-retaining components are suitable for gripping the cut end of the tree trunk. The tree-retaining components may comprise at least one projection arranged to grip the cut end of the tree trunk, for example a plurality of projections being provided. In an embodiment the projections may be arranged vertically within the tree-receiving portion, alternatively the projections may be arranged horizontally within the tree-receiving portion. In an embodiment there may be a plurality of projections wherein some of the projections are arranged horizontally and some are arranged vertically, for example at least one projection is arranged horizontally and at least one projection is arranged vertically.

The tree-retaining components may be mounted to the tree-receiving portion. In order to accommodate cut trees of different sizes the tree-retaining components may be arranged to flex in response to an end of a cut tree trunk received in the tree-receiving portion and thereby apply a gripping force to an end of a cut tree trunk. Each tree retaining component may have the same depth or they may have different depths.

The tree-retaining components may comprise at least one set of two projections mounted to the tree-receiving portion. These projections may be referred to as "tree-retaining projections". The tree-retaining projections may be arranged vertically within the tree-receiving portion. The tree-retaining components may comprise multiple sets of two tree-retaining projections mounted to the tree-receiving portion, for example at least two sets, at least three sets, at least four sets, at least five sets, at least six sets. In an embodiment the tree-receiving portion comprises three sets of two tree-retaining projections. Wherein there are multiple sets of two tree-retaining projections, the sets may be spaced at substantially even intervals within the tree-receiving portion. In an embodiment the space in between the two tree-retaining projections in the set, is smaller than the space between each set of two tree-retaining projections. The tree retaining projections may be arranged to accommodate cut trees of different sizes. In order to accommodate cut trees of different sizes the tree-retaining projections may be arranged to flex in response to an end of a cut tree trunk received in the tree-receiving portion and thereby apply a gripping force to an end of a cut tree trunk. The strength of the tree retaining projections may be selected such that the tree-retaining projections provide stability to the cut end of the tree, whilst also being flexible such that the tree-retaining projections can move in response to a cut end of tree being placed within the tree-receiving portion.

Without wishing to be bound by theory, it is thought that the grouping of the tree-retaining projections in pairs at substantially even intervals within the tree-receiving portion provides an advantageous spacing arrangement. In particular this advantageous spacing arrangement may be achieved wherein the space in between the two tree-retaining projections in the set, is smaller than the space between each set of two tree-retaining projections. This spacing arrangement allows sufficient space for both the insertion of the end of a cut tree trunk and space for the projections to flex in response to the end of a cut tree trunk whilst also providing stability to the cut tree trunk. The arrangement of three sets of two tree-retaining projections at substantially even intervals within the tree-receiving portion may be particularly effective for achieving this spacing arrangement.

In an embodiment the tree-receiving portion is generally cylindrical. The tree-receiving portion may be split into multiple distinct sections for example two or more sections, three or more sections, four or more sections, five or more sections, six or more sections. Each of the section of the tree-receiving portion may be able to move relative to the other sections. Wherein the tree-receiving portion comprises multiple sections this arrangement may be particularly advantageous to accommodate the cut end of a tree with a larger circumference as the sections of the tree receiving portion can flex outwards in response to the end of a cut tree trunk. In an embodiment each section of the tree-receiving portion has the same or similar height. Alternatively, some of the sections have a larger height compared to the other sections.

In an embodiment the sections of the tree-receiving portion may comprise tree-retaining projections. The tree retaining projections may be mounted on the sections of the tree-receiving portion, the projections may be arranged vertically and/or horizontally on the sections of the tree-receiving portion. Each tree-retaining projection may have the same depth or they may have different depths. In an embodiment all of the tree of the sections of the tree-receiving portion. Wherein the sections of the tree-receiving portion comprise different heights, it may be advantageous for the sections with the larger height to comprise tree-retaining projections.

The tree-retaining projections act to reinforce the connection between the base of the tree stand and the tree-receiving portion, thereby improving stability of the tree stand. The tree-retaining projections also reinforce the connection between the base and the projection.

The tree-receiving portion and the projection may be provided as a removable insert which can then be connected to the base of the tree stand. The tree-receiving portion of the insert may comprise one or more tree-retaining components. The tree-receiving portion of the insert may comprise one or more tree-retaining components which may comprise multiple sets of two tree-retaining projections mounted to the tree-receiving portion, for example at least two sets, at least three sets, at least four sets, at least five sets, at least six sets In one example the insert is to be connected within the fluid reservoir. Suitably there is an appropriate insert receiving region within the tree stand. The insert may be connected to the tree stand by any suitable means, for example it is a push fit within the tree stand. The insert may also comprise a lip and/or other suitable interference-fit portion to engage with the tree stand, to limit its insertion into the tree stand, and/or hold the projection in place with the tree stand.

In a second aspect, there is provided a kit comprising a tree stand according to the first aspect, and a cut tree.

In one example, tree is provided with a recess cut into the centre of the tree trunk, wherein the projection of the tree stand can be inserted. This recess may be produced by any reasonable means for example cutting or carving into the tree by mechanical means or by hand.

The term "cut tree" refers to a tree which has been cut by any suitable means to provide a cut end of the trunk of the tree distal to the apex of the tree. Thus trees may be cut by chopping, cutting, sawing and the like for example.

In one example the cut tree is suitable for use a Christmas tree.

In a third aspect of the present invention there is provided a method of securing a cut tree in a tree stand comprising the steps of:

(i) providing a tree stand according to the first aspect above, and a tree with a cut end;
(ii) using mechanical force to insert the projection of the tree stand into the cut end of the tree trunk.

To insert the projection into the cut end of the tree trunk a mechanical force such as hammering may be used.

Wherein the projection is provided as removable insert as discussed above the method of securing a cut tree in a tree stand may comprise the steps of:

(i) providing a tree stand according to the first aspect above, and a tree with a cut end;
(ii) using mechanical force to insert the removable insert comprising the projection of the tree stand into the cut end of the tree trunk;
(iii) attaching the insert into the base of the tree stand.

In one example, the method comprises the step of forming a recess into the centre of the cut end of the tree wherein the projection is to be inserted. This step is to be performed prior to step (ii). In one example the method comprises cutting or boring the recess.

In one example the method comprises forming the recess by machining. In one example the method comprises forming the recess by a manual carving process.

To insert the projection into the cut end of a tree trunk the tree stand may be placed on a flat surface and the cut end of the tree trunk placed onto the projection. Force can be applied downwards through the tree to aid the insertion.

The tree may be placed on its side or another suitable orientation, and the projection inserted. Force can then be applied through the base of the tree stand to aid the insertion. The tree and the tree stand can then be placed upright.

In one example the method further comprises the step of adding water to the fluid reservoir, for example to partly or completely fill the reservoir. Water may be added when the stand is used in a retail display or in a home over the Christmas period.

BRIEF INTRODUCTION TO THE FIGURES

For a better understanding of the invention, and to show how embodiments of the same may be carried into effect, reference will now be made, by way of example, to the accompanying diagrammatic drawings in which.

DESCRIPTION OF EXAMPLE EMBODIMENTS

Figure 1:
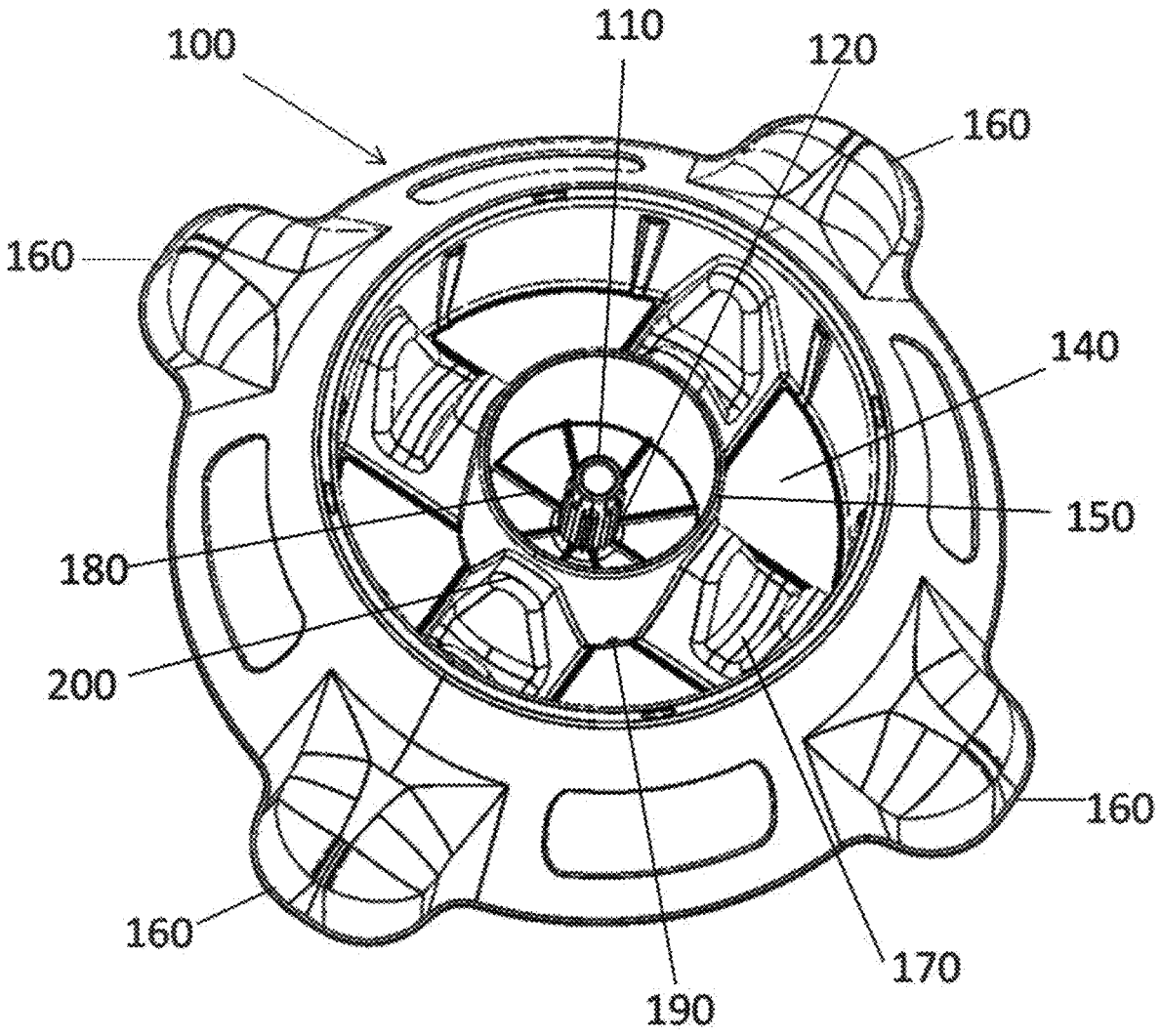
FIG. 1 illustrates an upper perspective view of a tree stand according to an example embodiment of the invention.
Figure 2:
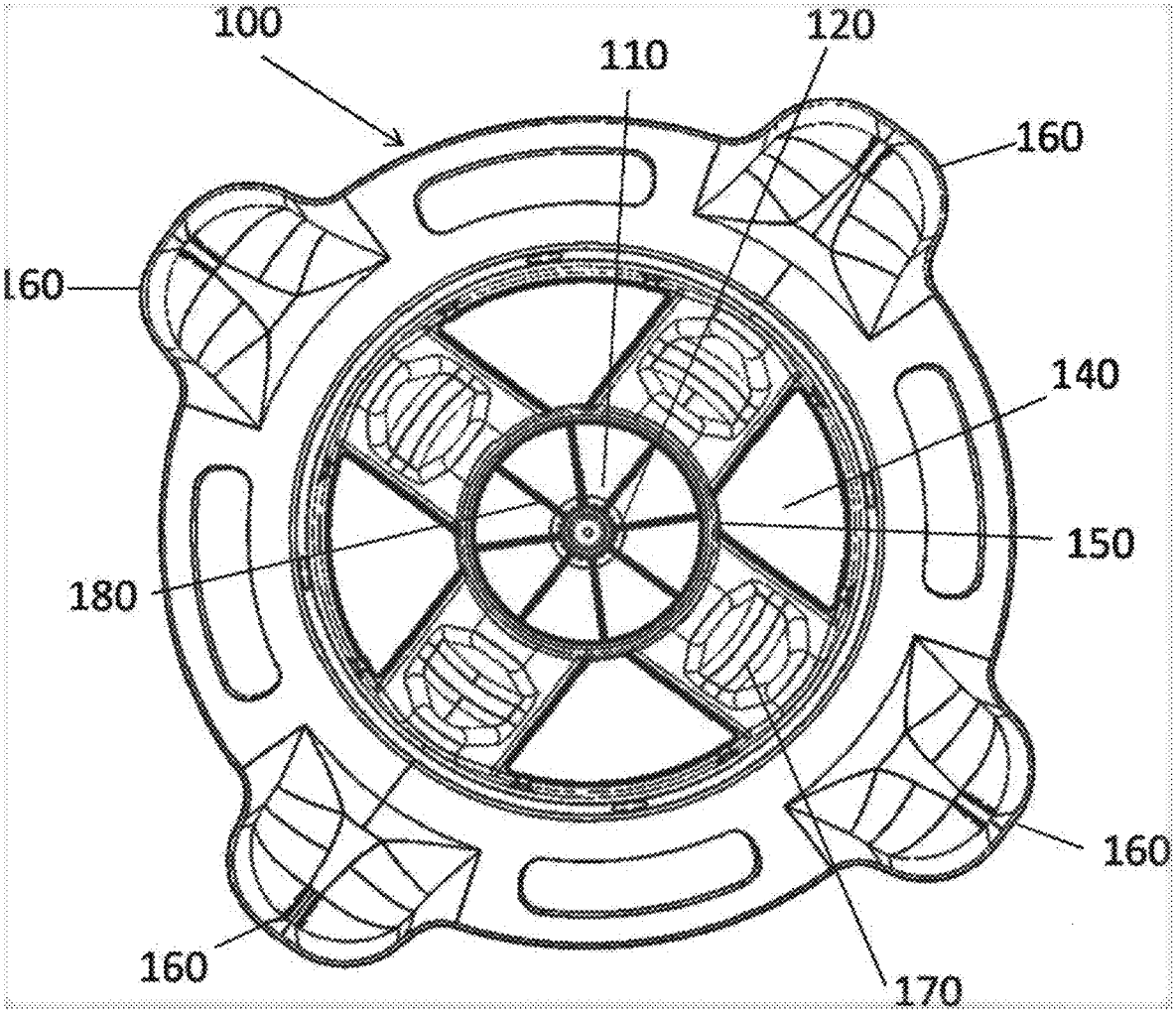
FIG. 2 illustrates a to side view of the tree stand of FIG. 1.

Referring to FIGS. 1 and 2, there is shown a tree stand 100 which comprises a projection 110. The projection 110 is upwardly-orientated, and comprises a plurality of upwardly-orientated ribs 120. The ribs 120 are arranged around the projection 110, extending from the outer surface of the projection 110. The projection 110 is located within a tree-receiving portion 150. The projection 110 and tree-receiving portion 150 are connected concentrically within the fluid reservoir 140, with these three elements all substantially cylindrical in shape. The tree-receiving portion 150 comprises an aperture 190, located at its base, which allows fluid communication between the tree-receiving portion 150 and the fluid reservoir 140.

In use, projection 110 and ribs 120 are inserted into the cut end of a tree trunk to be supported in the tree stand 100. In order to aid insertion, the ribs 120 comprise sharp, for example pointed edge portions which can at least partially cut into the inside of the tree. Similarly, the projection 110 may be formed by a wall that defines a hollow interior portion, with a sharp edge. In this way the cut end of the tree may be more easily penetrated. Additional support for the cut end of the tree may in this way be provided by engagement of the interior surface of the projection 110.

Further, the circumference of the cut end of the tree is chosen to be similar or smaller than the interior circumference of the tree-receiving portion 150, so that the insertion is not hindered, but additional support for the tree may be provided by engagement of the cut end of the tree with the inwardly facing surface of the tree-receiving portion 150. In other embodiments, not shown, the inwardly facing surface of the tree-receiving portion 150 is also provided with ribs, inwardly facing, that are able to penetrate an exterior portion of the cut end of the tree to provide additional support.

Once the tree is supported by the tree stand 100, water can be poured into the fluid reservoir 140. The aperture 190 allows the water to enter the tree-receiving portion and access the cut end of the tree. There are spacers 180 within the tree-receiving portion 150 which elevate the base of the tree and allow water to access the base of the tree. These spacers may have indents or apertures to aid water transfer.

There are strengthening elements 200 within the tree stand which help provide structural integrity. The strengthening elements 200 comprise hollow, arched sections which extend across the fluid reservoir 140 between the exterior of the tree-receiving portion 150 and the outer wall of the fluid reservoir 140. The strengthening elements 200 extend upwardly from, and are provided by, portions of the base of the fluid reservoir 140. Indents 170 within the strengthening elements 200 allow water to easily transfer throughout the fluid reservoir 140.

The tree stand comprises multiple feet 160 to help stabilise the base.

Figure 3:
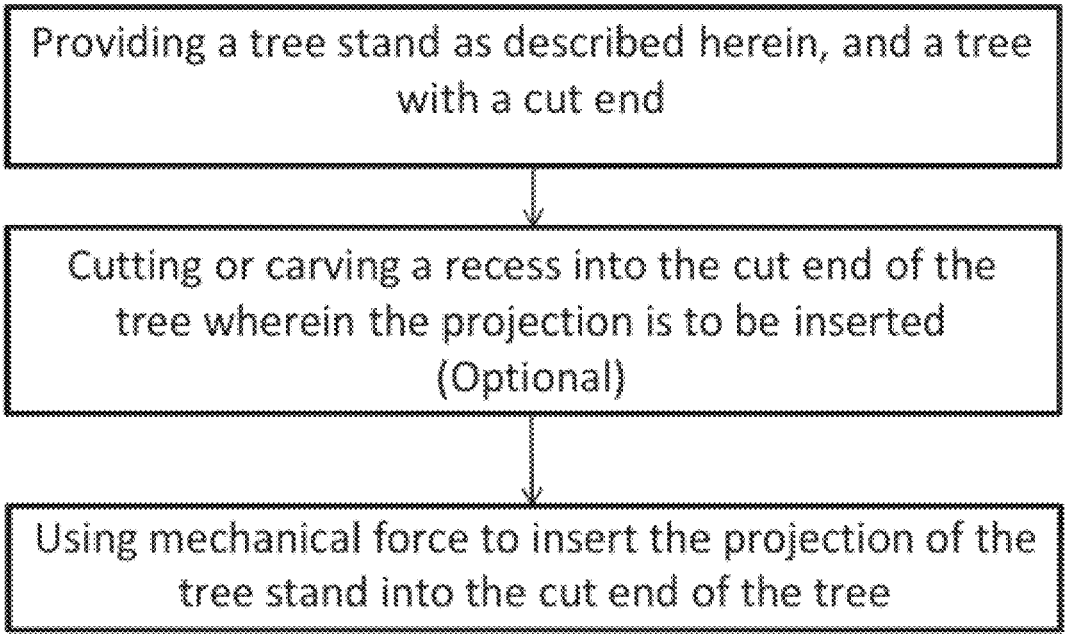
FIG. 3 illustrates a method of securing a cut tree within a tree stand of the present invention.

FIG. 3 illustrates the steps required for securing a tree within a tree stand according to the present invention. Firstly, a tree stand according to the present invention and a tree with a cut end are provided. Mechanical force is then used to insert the projection of the tree stand into the base of the cut end of the tree trunk. Optionally the method also comprises the step cutting or carving a recess into the base of the cut end of the tree trunk. This optional step is performed before the step of inserting the projection into the cut end of the tree trunk.

Figure 4:
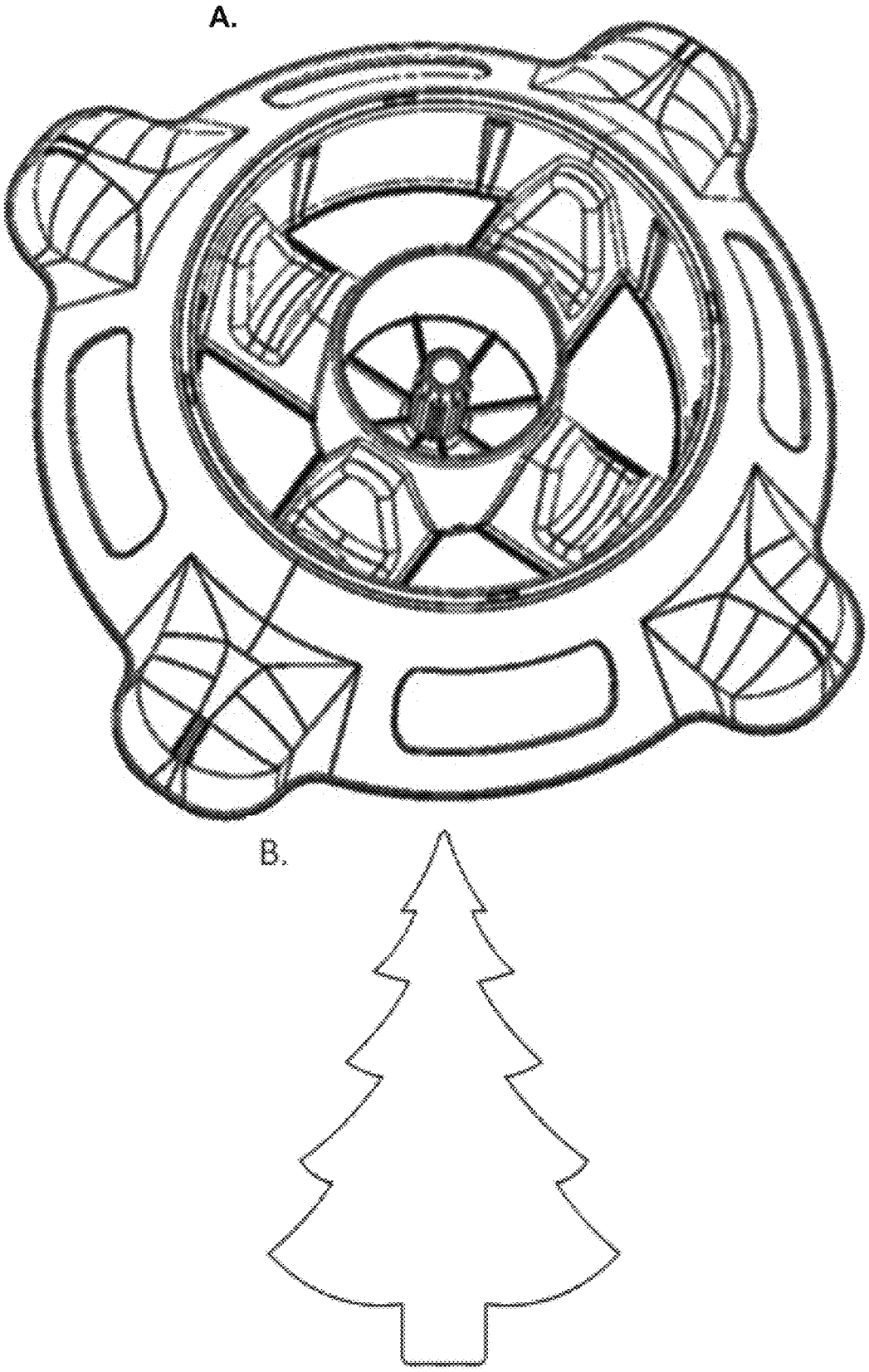
FIG. 4 illustrates a kit comprising a tree stand and a cut tree.

FIG. 4 provides a schematic of a kit comprising a tree stand according to the present invention (A.) and a cut tree (B.). The tree stand may be provided as a single item or may be provided as parts to be assembled. For example, the projection and ribs may be provided as a removable insert which can be connected to the base of the tree stand.

Figure 5:
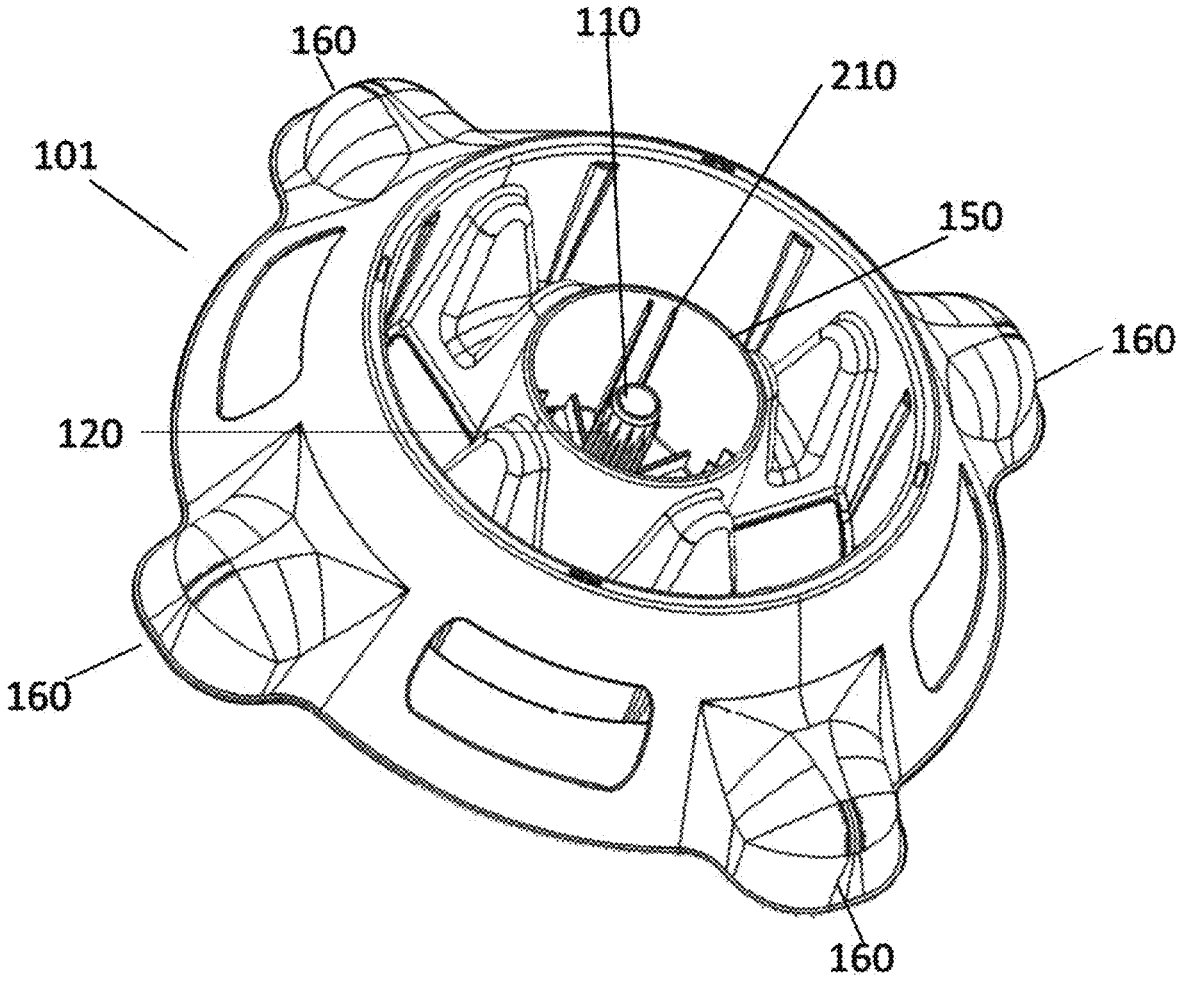
FIG. 5 illustrates an upper perspective view of a tree stand according to an example embodiment of the invention.
Figure 6:
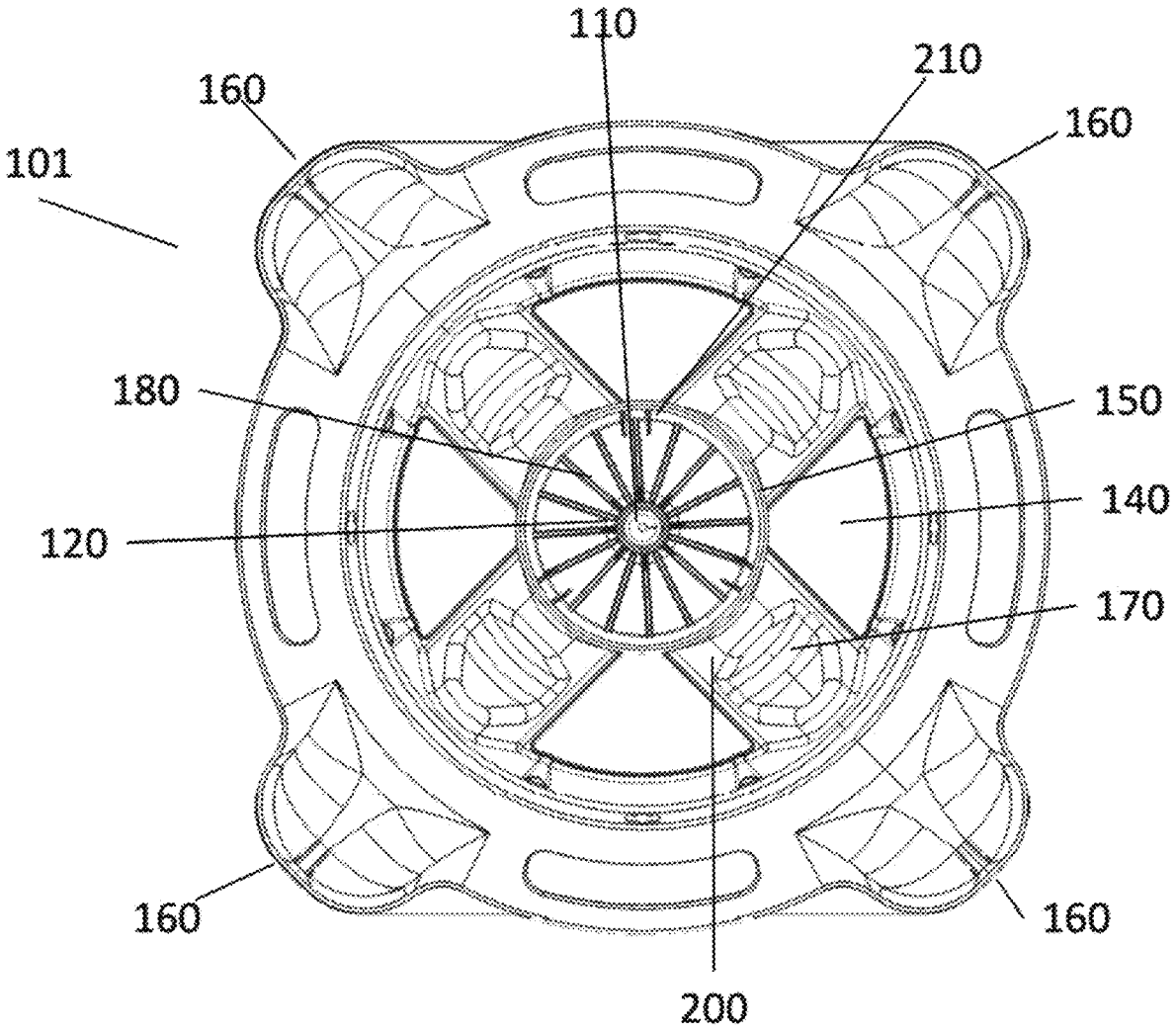
FIG. 6 illustrates a top side view of the tree stand of FIG. 5.
Figure 7:
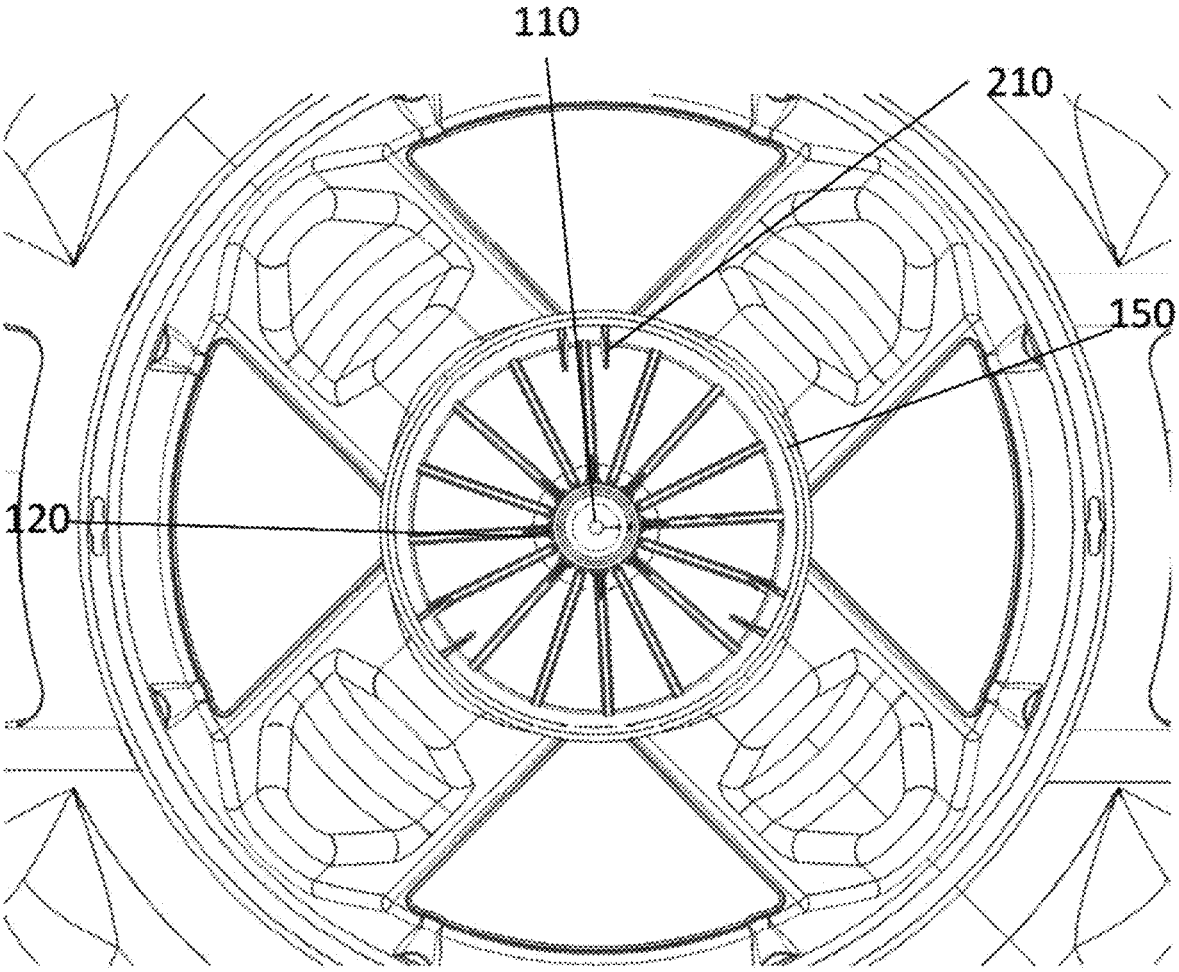
FIG. 7 illustrates an expanded top side view of the tree stand of FIG. 5.
Figure 8:
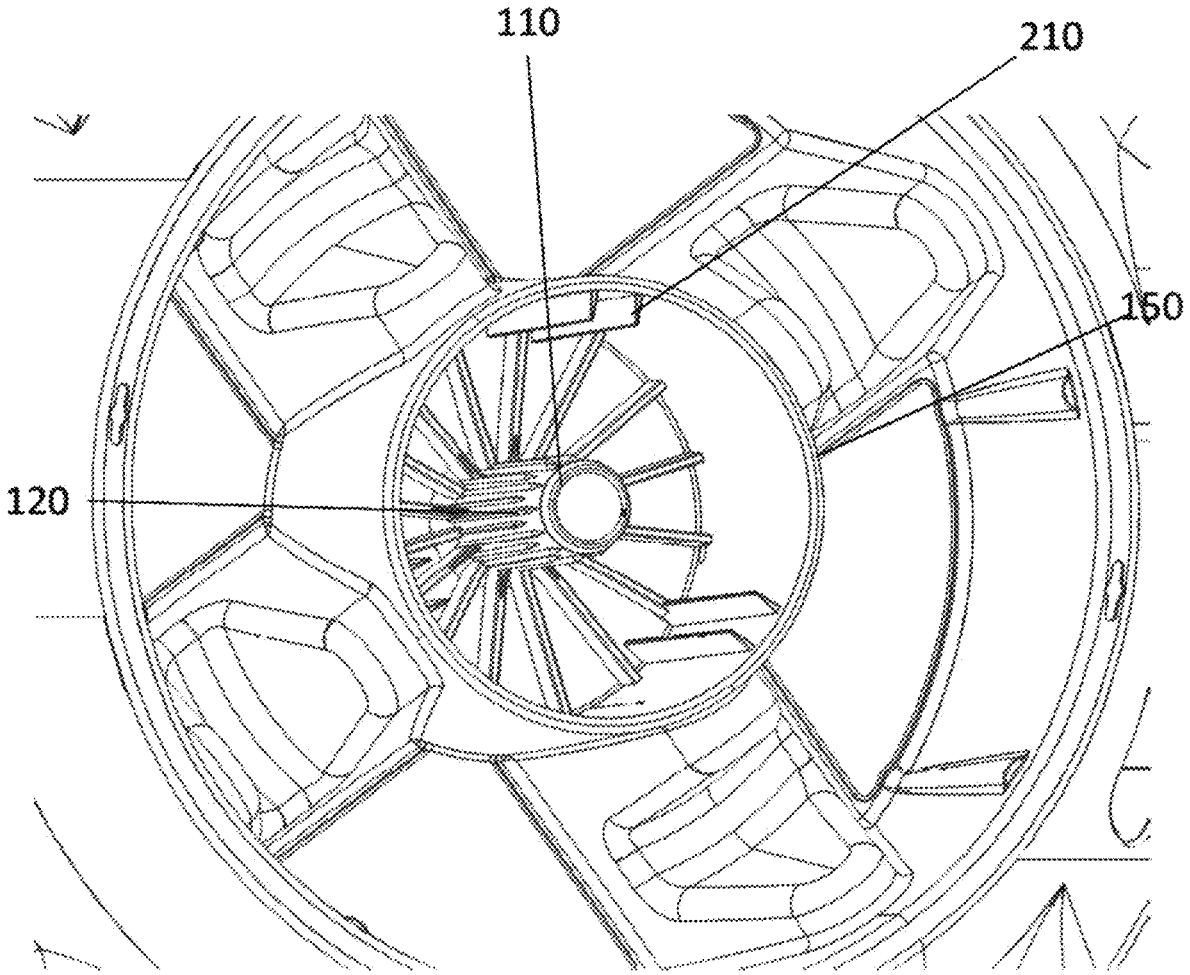
FIG. 8 illustrates an expanded upper perspective view of the tree stand of FIG. 5.

FIGS. 5 and 6 show a tree stand 101 comprising the features of FIGS. 1 and 2. The tree stand 101 further comprises tree retaining projections 210 mounted on the tree receiving portion 150. There are three sets of two tree retaining projections mounted at substantially even intervals within the tree receiving portion 150. In use the tree retaining projections 210 arranged to flex in response to an end of a cut tree trunk received in the tree-receiving portion and thereby apply a gripping force to an end of a cut tree trunk. FIGS. 7 and 8 show expanded views of the views in FIGS. 5 and 6.

In summary, example embodiments described herein provide a number of advantages over previously known tree stands. The ribs of the projection act to increase the surface area which is in contact with the inside of the cut tree trunk, when compared to a tree stand which uses a regular projection. The increased contact area improves the stabilisation of the tree, whilst also securing the tree to the stand. Example embodiments also enhance water uptake by the tree. The ribs cut into the xylem containing portion of the tree trunk and so provide pathways for water to enter the trunk of the tree. Improved water uptake will allow the tree the stay green and look fresh for longer. As such, this tree stand is particularly suited for displaying trees such as those intended to be Christmas trees, as these trees are generally displayed for a prolonged period of time.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All the features disclosed in this specification (including any accompanying claims, abstract and drawings), and/or all the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

Numbered Embodiments of the Invention

1. A tree stand comprising: a projection comprising a plurality of ribs for insertion into the cut end of a tree trunk to thereby engage and support the tree, wherein the projection is upwardly-orientated and the ribs are upwardly-orientated.

2. The tree stand of any preceding embodiment, wherein the ribs are arranged on the outside of the projection.

3. The tree stand of any preceding embodiment, wherein the projection is vertically-orientated.

4. The tree stand of any preceding embodiment, wherein the ribs are arranged around the outer surface of the projection.

5. The tree stand of any preceding embodiment, wherein the ribs extend outwards from the projection.

6. The tree stand of any preceding embodiment, wherein the ribs extend radially outwards from the projection.

7. The tree stand of any preceding embodiment, wherein the ribs are vertically-orientated.

8. The tree stand of any preceding embodiment, wherein the projection and ribs are orientated in the same direction.

9. The tree stand of any preceding embodiment, wherein the projection and/or ribs are made from plastic.

10. The tree stand of any preceding embodiment, wherein the projection and/or ribs are made from metal.

11. The tree stand of any of any preceding embodiment, wherein the ribs are arranged parallel to one another.

12. The tree stand of any preceding embodiment, wherein the ribs are rectilinear.

13. The tree stand of any preceding embodiment, wherein one or more of the ribs comprise a sharp or pointed portion.

14. The tree stand of any preceding embodiment, wherein the ribs have a depth which varies along the length of the rib.

15. The tree stand of any preceding embodiment, wherein the ribs have a depth which tapers along the length of the rib.

16. The tree stand of any preceding embodiment, wherein the ribs have a depth which is smaller at the upper end thereof than at the lower end thereof.

17. The tree stand of any preceding embodiment, wherein the ribs have a thickness which varies along the length of the rib.

18. The tree stand of any one of preceding embodiment, wherein the ribs have a thickness which tapers along the length of the rib.

19. The tree stand of any preceding embodiment, wherein the ribs have a thickness with is smaller at the end thereof away from the projection than at the end at the projection.

20. The tree stand of any preceding embodiment, wherein the projection is generally cylindrical.

21. The tree stand of any preceding embodiment, wherein the projection is open at an upper end.

22. The tree stand of any preceding embodiment, wherein the projection comprises a cylindrical shell from which the ribs extend outwards.

23. The tree stand of any preceding embodiment, wherein the projection comprises a generally hollow cylinder.

24. The tree stand of any preceding embodiment, wherein the projection comprises a strengthening component.

25. The tree stand of embodiment 23 or 24, wherein the projection comprises strengthening ribs on the inner surface of the projection.

26. The tree stand of embodiment 23 or 24, wherein the strengthening component is provided as a removable insert.

27. The tree stand of any preceding embodiment, wherein the stand further comprises a fluid reservoir.

28. The tree stand of any preceding embodiment, wherein the stand further comprises a base and the projection is mounted to the tree stand at the base.

29. The tree stand of embodiment 27, wherein the projection is provided within the fluid reservoir.

30. The tree stand of any preceding embodiment, wherein the projection is provided as a removable insert.

31. The tree stand of any preceding embodiment, wherein the stand further comprises a tree-receiving portion arranged to receive an end of a cut tree trunk.

32. The tree stand of embodiment 31, wherein the tree-receiving portion comprises tree-retaining components arranged to grip the cut end of the tree trunk.

33. The tree stand of embodiment 32, wherein the tree-retaining components comprise a plurality of projections arranged to grip the cut end of the tree trunk.

34. The tree stand of embodiment 31 to 33, wherein the tree-receiving portion comprises multiple sections.

35. The tree stand of any preceding embodiment, wherein the stand comprises at least one tree-retaining components that is mounted to the tree-receiving portion, wherein the tree-retaining components are arranged to flex in response to an end of a cut tree trunk received in the tree-receiving portion and thereby apply a gripping force to an end of a cut tree trunk.

36. The tree stand of any one of embodiments 32 to 35, wherein the tree retaining components comprise three sets of two tree-retaining projections arranged to grip the cut end of the tree trunk.

37. The tree stand of embodiment 36, wherein the three sets of two tree-retaining projections arranged at substantially even intervals within the tree-receiving portion.

38. A kit comprising: a tree stand of any one of embodiments 1 to 37 and a tree.

39. A kit of embodiment 38, wherein the tree is provided with a recess cut into the centre of the tree trunk, wherein the projection of the tree stand can be inserted.

40. A method of securing a cut tree within a tree stand, comprising the steps of:

(i) providing a tree stand according to any of embodiments 1 to 37, and a tree with a cut end;

(ii) using mechanical force to insert the projection of the tree stand into the cut end of the tree.

41. The method of embodiment 40, wherein the method comprises an additional step, prior to step (ii), of cutting or carving a recess into the centre of the cut end of the tree wherein the projection is to be inserted.

The invention claimed is:

1. A tree stand comprising: a projection comprising a plurality of ribs for insertion into a cut end of a tree trunk to thereby engage and support the tree, wherein the projection is upwardly-orientated and the ribs are upwardly-orientated wherein:

each of the plurality of ribs define a length that is coplanar to the upward orientation of the projection;

the length of each of the plurality of ribs is greater than both a width and a depth of each of the plurality of ribs;

one or more of the plurality of ribs comprise a sharp or pointed portion;

in use, the projection and ribs are inserted into the cut end of the tree trunk;

wherein an outer perimeter of the projection and ribs is configured to not exceed a circumference of the cut end of the tree trunk;

wherein the stand further comprises a tree-receiving portion arranged to receive an end of a cut tree trunk;

wherein the tree-receiving portion comprises tree-retaining components arranged to grip the cut end of the tree trunk;

wherein the tree-retaining components comprise a plurality of tree-retaining projections arranged to grip the cut end of the tree trunk; and wherein the tree-retaining projections act to reinforce a connection between a base of the tree stand and the tree-receiving portion, thereby improving stability of the tree stand.

2. The tree stand of claim 1, wherein the projection and/or ribs are made from plastic.

3. The tree stand of claim 1, wherein the projection comprises a cylindrical shell from which the ribs extend outwards.

4. The tree stand of claim 1, wherein the projection comprises a hollow cylinder.

5. The tree stand of claim 4, wherein the projection comprises strengthening ribs on an inner surface of the projection.

6. The tree stand of claim 1, wherein the projection comprises a strengthening component.

7. The tree stand of claim 6, wherein the strengthening component is provided as a removable insert.

8. The tree stand of claim 7, wherein the tree-retaining components comprise three sets of two tree-retaining projections arranged to grip the cut end of the tree trunk.

9. The tree stand of claim 1, wherein the stand further comprises a fluid reservoir and the projection is provided within the fluid reservoir.

10. The tree stand of claim 1, wherein the projection is provided as a removable insert.

11. The tree stand of claim 1, wherein the tree-receiving portion comprises multiple sections.

12. The tree stand of claim 1, wherein the stand comprises at least one tree-retaining components that is mounted to the tree-receiving portion, wherein the tree-retaining components are arranged to flex in response to an end of a cut tree trunk received in the tree-receiving portion and thereby apply a gripping force to an end of a cut tree trunk.

13. A method of securing a cut tree within a tree stand, comprising the steps of:

(i) providing a tree stand according to claim 1, and a tree with a cut end;

(ii) using mechanical force to insert the projection of the tree stand into the cut end of the tree.

* * * * *